United States Patent [19]

Xavier

[11] 4,074,944

[45] Feb. 21, 1978

[54] DISPENSING DEVICE

[76] Inventor: Octavio Marques Xavier, 25206 York Circle, Laguna Hills, Calif. 92653

[21] Appl. No.: 739,467

[22] Filed: Nov. 8, 1976

[51] Int. Cl.[2] ..... B43K 5/06

[52] U.S. Cl. ..... 401/182; 401/287; 401/289

[58] Field of Search ..... 401/182, 176–181, 401/187, 188, 268, 270, 278, 286, 287, 289, 143, 170, 171; 222/386, 391

[56] References Cited

U.S. PATENT DOCUMENTS

| | | | |
|---|---|---|---|
| 1,067,924 | 7/1973 | Johnson | 401/180 X |
| 1,216,239 | 2/1917 | Lovell | 401/287 X |
| 1,509,420 | 9/1924 | Edelman | 401/182 |
| 2,641,012 | 6/1953 | Storrs | 401/282 X |
| 2,948,007 | 8/1960 | Tanguay | 401/173 |
| 3,135,990 | 6/1964 | Bergman et al. | 401/286 |

*Primary Examiner*—Stephen C. Pellegrino

*Attorney, Agent, or Firm*—Charles T. Silberberg

[57] ABSTRACT

A device for dispensing a fluid or plastic material from the chamber of a housing to brush bristles connected to said housing so that the material, such as a cleansing material, can be used in combination with the brush bristles. A reciprocal rod has an annular cavity adapted to fit a plurality of telescopic cylindrical members therein. A piston is preferably connected to one of said members and forms a movable wall of said chamber. Reciprocal movement of the rod causes the piston to be shifted longitudinally within the housing to selectively force material from said chamber through a pressure sensitive valve to the bristles. The telescopic members allow for the device to be of a minimum length while still allowing for substantially complete dispensing of the material within the chamber. Optionally, a separate container can be used to supply material to the housing chamber.

8 Claims, 8 Drawing Figures

FIG. 1
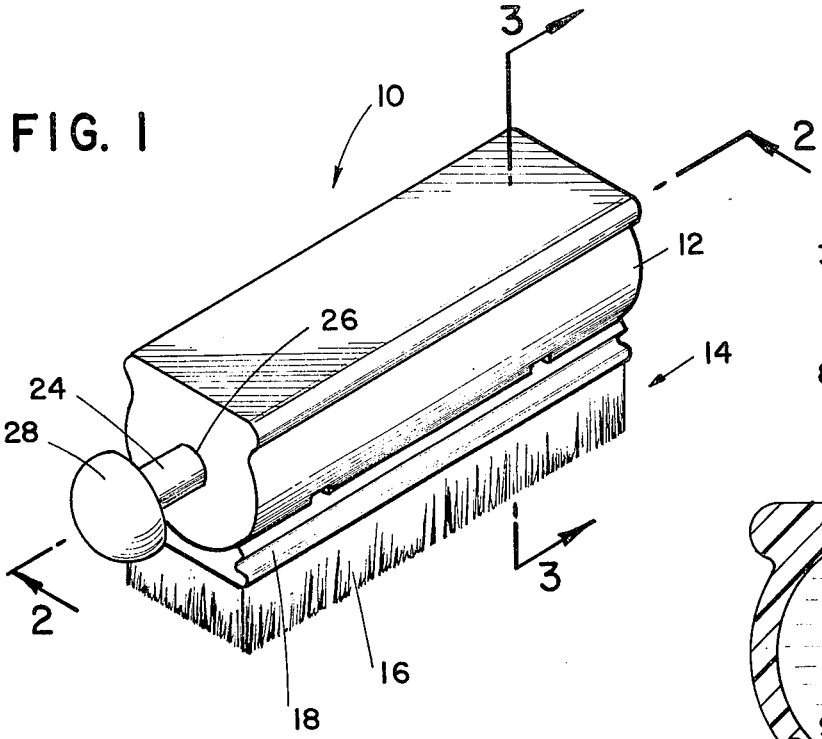
FIG. 4
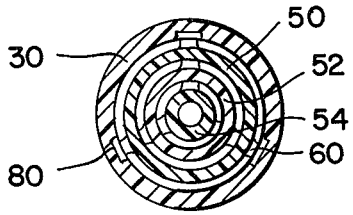
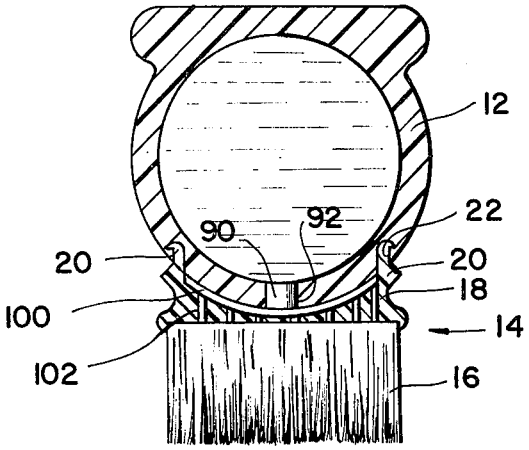
FIG. 3
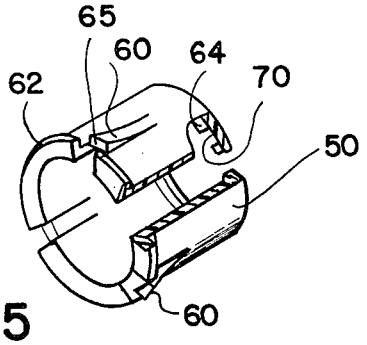
FIG. 5
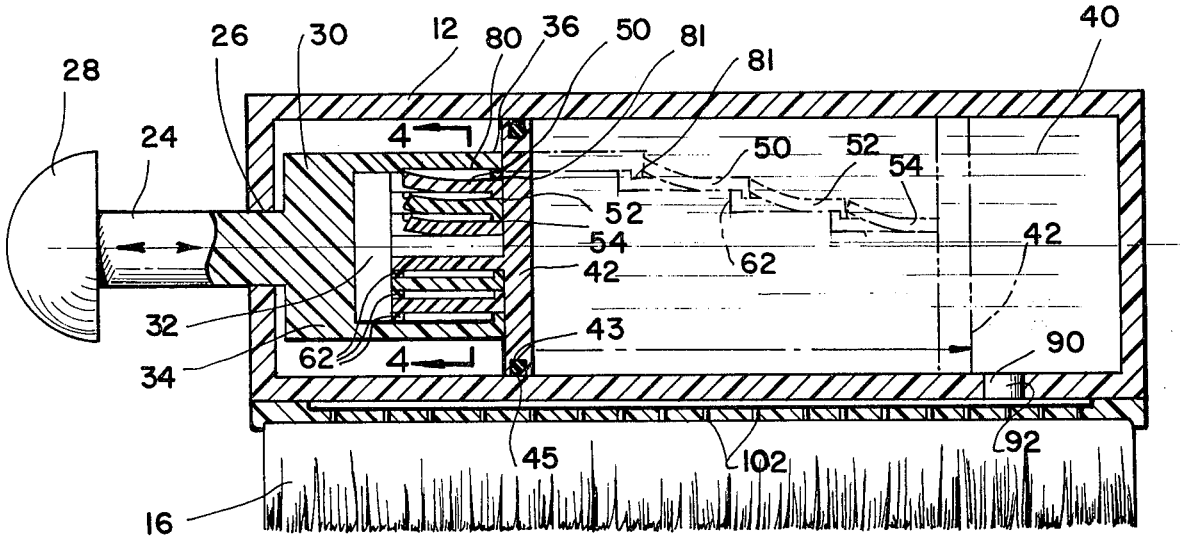
FIG. 2

DISPENSING DEVICE

BACKGROUND OF THE INVENTION

This invention relates to a device for carrying a supply of material from which small portions may, from time to time, be separated from the supply for use as desired. The invention is particularly adaptable to what may be termed as a fountain brush. This type of mechanism allows for dispensing of a plastic or liquid type material, such as toothpaste or a cleansing material to the bristles of a brush (or something similar such as a sponge or felt pad).

Typical of the prior art are U.S. Pat. No. 1,538,225 to Stockseth and U.S. Pat. No. 1,325,268 to Sosdian. The Stockseth patent shows a device whereby a screw-fed piston forces fluid from a reservoir to the brush. The Sosdian patent discloses a reservoir having a spring-biased piston therein where fluid is allowed to flow from the reservoir to the brush upon the opening of a manually-controlled normally closed valve. Unfortunately these type of devices have proved unsatisfactory for various reasons. For example, the Stockseth device provides for annoyingly slow screw feed of the fluid to the bristles with limited control over stopping the flow once it starts, i.e., additional rotation of the shaft is required to either close the outlet or reverse the movement of the piston. With the Sosdian invention, control is also difficult because it varies greatly with the amount of material in the reservoir. Thus, the pressure exerted by spring 15 is greatest when the reservoir is fullest, but this decreases markedly as the reservoir empties. Thus, the user never knows how much fluid will be dispensed for a given amount of time that the valve is left open.

Some other prior art that is of interest are U.S. Pat. No. 3,284,838 to Bieganowski and U.S. Pat. No. 2,948,007 to Tanguay. The Bieganowski patent discloses a reservoir which is separate from the brush, i.e., a fluid line running through the brush connects the reservoir, a pressure pump, to the brush bristles. No chamber or piston-like device is provided within the brush. The Tanguay patent discloses a device having a piston made up of two telescopic parts. However, this device also suffers from the same problem of the prior art such as with the Stockseth patent in that each of the telescopic parts are threaded and the inside of the housing is threaded to allow for movement of the piston to compress the fluid. This then only allows for slow and inaccurate control of the fluid flow from the chamber.

SUMMARY OF THE INVENTION

It is, therefore, an object of the present invention to provide an efficient, practical, and inexpensive dispensing device.

It is another object of the present invention to provide a dispensing device which is so designed as to have a minimum length compared to the quantity of material contained therein so that the device will be compact.

It is yet another object of the present invention to provide a dispensing device which allows for fast and accurate control of the fluid dispensed to the brush.

Briefly, in accordance with the invention, there is provided a device for dispensing a liquid or plastic material from the chamber of a hollow housing to brush bristles connected to the housing. A reciprocal rod within the housing has an annular cavity at one end having a plurality of telescopic cylindrical members positioned therein when unexpanded. A piston forms a movable wall of the chamber. The piston is shiftable longitudinally within said housing by reciprocal movement of the rod. A valve selectively opens and closes a discharge passage which connects the chamber to the brush bristles. The cylindrical members are each provided with a detent on the outer surface thereof. At least the outer cylindrical member has an end with an outwardly extending flange and the other end with an inwardly extending flange. Optionally, a supply container having a reservoir of material therein can be used to supply such material to the chamber within the housing.

Other objects and advantages of the invention will become apparent upon reading the following detailed description and upon reference to the drawings.

BRIEF DESCRIPTION OF THE DRAWINGS

FIG. 1 is a perspective view of the dispensing device embracing the principles of this invention;

FIG. 2 is a sectional view of the dispensing device of FIG. 1 taken in the direction of arrows 2—2 of FIG. 1;

FIG. 3 is a sectional view of the dispensing device of FIG. 1 taken in the direction of arrows 3—3 of FIG. 1;

FIG. 4 is a sectional view of the telescopic assembly of the present invention taken in the direction of arrows 4—4 of FIG. 2;

FIG. 5 is a detail perspective view with a portion broken away of one of the cylindrical telescopic members of the present invention;

Figure 6:
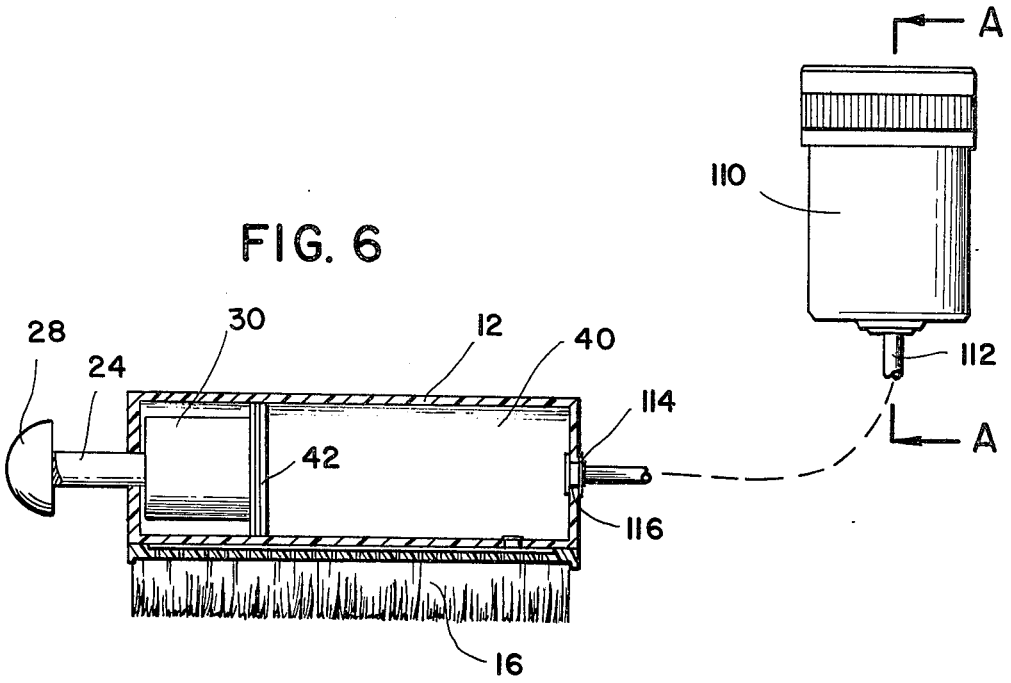
FIG. 6 is a diagrammatic illustration of the present dispensing device employing a supply container with the mechanism of FIG. 2.

While the invention will be described in connection with the preferred embodiments, it will be understood that it is not intended to limit the invention to those embodiments. On the contrary, it is intended to cover all alternatives, modifications, and equivalents that may be included within the spirit and scope of the invention as defined by the appended claims.

DETAILED DESCRIPTION OF THE INVENTION

Turning first to FIG. 1, there is shown an example of carrying out the present invention where the dispensing device is a portable version. The dispensing device is generally indicated at 10 and includes a hollow, substantially cylindrical housing 12. With further reference to FIG. 3, connected to housing 12 is a brush assembly generally indicated at 14 which includes a plurality of bristles 16 which are connected in conventional manner to a mounting plate 18. While bristles or brush hairs 16 are illustrated, other equivalent applicator members could be used, such as felt pad or sponge. Mounting plate 18 can be integral with housing 12 but preferably is removably attachable thereto such as by a plurality of protruding arms 20, which are preferably resilient and which fit within corresponding slots 22 within housing 12.

Referring now to FIG. 2, it is seen that a rod 24 extends into housing 12 through an orifice 26. The end of rod 24 outside housing 12 has an enlarged portion 28 which is provided for ease of control of rod 24 by a user of the dispensing device 10. The other end of rod 24, which is within housing 12, is in the form of an enlarged cylindrical cup-like portion 30 having an annular cavity 32 defined between a transverse central member 34 and integral axially extending ring 36.

Also within housing 12 is defined a cylindrical chamber 40. One wall of chamber 40 is defined by a movable cylindrical piston 42. Within chamber 40 is provided the liquid or plastic material to be dispensed to bristles 16. This material can be water, cleansing compound, medication, toothpaste, or any similar-type fluid where it is desirable to have the combination of a brush or applicator with the fluid. Piston 42 has a circumferential groove 43 in which is positioned an O-ring 45 which seals the fluid within chamber 40.

When chamber or reservoir 40 is full of fluid, the piston is at the outer end of its stroke as shown by the solid lines of FIG. 2. In this initial position, a plurality of telescopic cylindrical members, shown as three members 50, 52, and 54, are positioned with annular cavity 32 of rod 24. As can best be seen with reference to FIG. 5, each of the cylindrical members (member 50 is illustrated, but all would preferably be the same except for diameter) has a plurality of resilient detents 60 cut from the surface thereof which are biased outwardly. At one end of the cylindrical members is provided a preferably integral outwardly extending flange 62. At the other end of the cylindrical members is provided a preferably integral inwardly extending flange 64. The total width of flanges 62 and 64 is less than the distance from contact surface 65 of detent 60 to the end of cylindrical member 50 having flange 62 thereof for a reason which will become apparent. Each of the cylindrical members is provided with a plurality of axially extending slots 70 which are designed to accommodate the projecting part of detents 60 of the immediately internally telescoping cylindrical member (slot 70 and flange 64 need not be provided on cylindrical member 54 as there is no internally telescoping member therein).

FIG. 4 illustrates the telescopic fit of cylindrical members 50, 52, and 54 within chamber 32 of cup portion 30. As can be seen, detents 60 fit within slots 70 of the immediately surrounding telescoping member. With regard to outer cylindrical member 50, its detents 60 fit within corresponding axial slots 80 within ring portion 36 of cup 30.

With reference to FIGS. 2 and 3, it is seen that a valve 90 is provided within an aperture or discharge passage 92 within housing 12. Valve 90 governs the access of fluid from chamber 40 to bristles 16. Valve 90 is preferably a check valve which is pressure sensitive. Thus, if the pressure within chamber 40 is below a certain predetermined value, valve 90 will prevent fluid flow therethrough. If, however, fluid pressure within chamber 40 exceeds a predetermined value, then valve 90 will allow fluid flow therethrough to bristles 16.

Fluid that flows from chamber 40 through valve 90 and discharge passage 92, is conveyed to bristles 16 through chamber 100 and a plurality of passages 102. Chamber 100 is defined by an annular recessed surface of plate member 18 which spaces plate member 18 from the periphery of housing 12 over such surface. Passages 102, which are located longitudinally and transversely to housing 12, run through plate member 18 and provide access from chamber 100 to bristles 16.

The portable dispensing device described operates as follows: When the chamber 40 is full of fluid, the piston 42 is at the outer end of its stroke as shown by the solid lines of FIG. 2. In this position, members 50, 52, and 54 are in complete telescopic engagement. This allows rod 24 to be of a minimum length in the distance it protrudes from housing 12, thereby making the device compact.

In order to feed fluid to bristles 16, it is only necessary to push rod 24 inward toward piston 42. This increases the pressure of fluid within chamber 40 by virtue of the inward movement of rod 24 being transmitted to piston 42 by contact with the end of ring portion 36. The pressure within chamber 40 by virtue of this piston movement is increased to a level whereby valve 90 allows fluid flow therethrough to bristles 16. When a desired amount of fluid has been allowed to flow to bristles 16, the flow can be quickly terminated by moving rod 24 outward away from piston 42. This removes the force behind piston 42, thereby relieving the pressure within chamber 40.

When a certain amount of the fluid within chamber 40 has been used, and it is necessary for rod 24 to be pushed inwardly until the enlarged end 28 almost contacts housing 12 in order to get further fluid flow, the return movement outward of rod 24, by virtue of the length of this stroke, will allow detents 60 of outer cylindrical member 50 to slide along slots 80 and pop out therefrom such that contact surfaces 65 will bear against the outer end of ring member 36. Due to the upward bias of detents 60, they will no longer return to slots 80. The downwardly extending flange 81 on the end of ring member 36 also is in contact with upwardly extending flange 62 of outer cylindrical member 50. Thus, outer cylindrical member 50 is at this point connected for movement in unison with reciprocal rod 24. This allows for the lengthening of the shaft 24 so that inward movement of rod 24 is transmitted through outer cylindrical member 50 to piston 42, whereby piston 42 can move further inward towards valve 90 to increase the pressure of fluid within chamber 40 when flow is desired to bristles 16. In likewise manner, cylindrical members 52 and 54 are expanded as shown by the broken lines in FIG. 2 and move in unison with each other and rod 24 so that piston 42 can be moved to minimize chamber 40 and substantially utilize all the fluid within such chamber.

Referring now to FIG. 6, there is shown another embodiment of the present invention where a stationary version is illustrated. In this version, the device as shown in FIG. 2 is utilized with the addition of a supply container 110 having pressurized fluid therein, supply line 112, and a valve 114 which passes through an orifice 116 at the end of housing 12 opposite to the wall of housing 12 through which shaft 24 passes. Valve 114 is a one-way pressure sensitive valve which allows fluid flow from supply container 110 into chamber 40 when the pressure within chamber 40 is below a predetermined value. Thus, when shaft 24 is positioned so as to not apply force to piston 42, pressure within chamber 40 is determined by the amount of fluid within chamber 40. When this pressure is below a certain predetermined value, valve 114 will allow fluid flow into chamber 40 until the pressure of fluid within chamber 40 exceeds the predetermined value.

Figure 7:
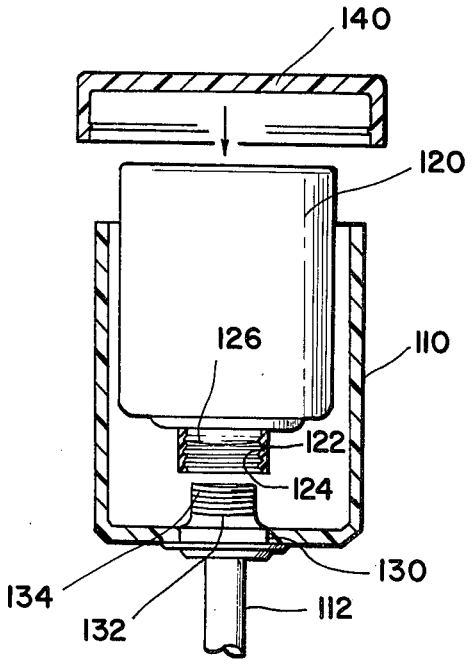
FIG. 7 is a sectional view of the supply container of FIG. 6 taken in the direction of arrows A—A of FIG. 6.
Figure 8:
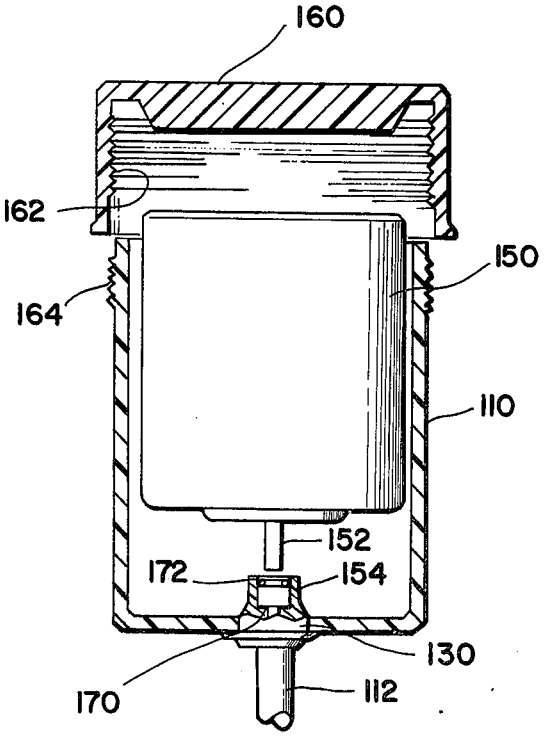
FIG. 8 is a sectional view of the supply container of FIG. 6 taken in the direction of arrows A—A of FIG. 6 and showing another embodiment thereof.

FIGS. 7 and 8 illustrate different embodiments of supply containers 110 and pressurized fluid capsules to fit therein. In FIG. 7, a sealed capsule 120 containing pressurized fluid has a cylindrical flange portion 122 which is internally threaded at 124. A seal 126 is provided within flange 122. Seal 126 prevents fluid from flowing from container 120. A port 130 at the bottom of supply container 110 is in fluid communication with line 112. Port 130 has a tubular portion 132 which protrudes into container 110. Portion 132 is threaded on its outer surface at 134 such that protruding portion 132 can be screwed within the threads 126 of flange 122. As such, when capsule 120 is rotated within container 110, protruding portion 132 will be screwed within flange 132 and eventually break the seal 126 so that the pressurized fluid within capsule 120 is allowed to flow through line 112 to valve 114. When capsule 120 is properly fitted within container 110, the lid 140 of supply container 110 can be placed thereon.

In FIG. 8, the capsule 150 which is illustrated is an aerosol-type container with fluid therein being under pressure. A valve head 152 allows fluid flow from capsule 150 when depressed. Portion 130 at the bottom of supply container 110 has a protruding portion 154 which extends into container 110 for engagement with valve head 152. A lid 160 for supply container 110 is internally threaded at 162 to mesh with external threads 164 on the outer upper surface of container 110. When lid 160 is screwed downward, it applies a downward force to capsule 150 forcing valve head 152 further within protruding portion 154. In this manner, valve head 152 eventually strikes an annular internal shoulder 170 within protruding portion 154 which depresses valve head 152 to allow fluid flow from capsule 150 through line 112 to valve 114. An O-ring 172 is provided within protruding portion 154 above shoulder 170 to seal protruding portion 154 to prevent backflow of fluid.

Thus, it is apparent that there has been provided, in accordance with the invention, a dispensing device that fully satisfies the objectives, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations which fall within the spirit and scope of the appended claims.

What is claimed is:

1. A device for dispensing a fluid material comprising:

a hollow housing, said housing having a chamber therein adapted to contain a supply of the material;

brush bristles connected to said housing;

a reciprocal rod within said housing, one end of said rod having an annular cavity therein, said one end having an inwardly extending flange thereon;

a plurality of telescopic cylindrical members adapted to be positioned within said cavity when unexpanded, each of said cylindrical members having a detent on the outer surface thereof, at least the outer member of said cylindrical members having one end with an outwardly extending flange and the other end with an inwardly extending flange;

a piston positioned within said housing, said piston forming a movable wall of said chamber, said piston adapted to be shifted longitudinally within said housing by reciprocal movement of said rod;

a discharge passage connecting said chamber to said bristles; and a valve for opening and closing said discharge passage, whereby the fluid material can be selectively dispensed to said bristles.

2. The device of claim 1 wherein said piston controls the material pressure within said chamber and said valve is responsive to said material pressure.

3. The device of claim 2 wherein said detent on said outer member of said cylindrical members is adapted to contact said one end of said rod, and the detent on each of the remaining cylindrical members is adapted to contact said other end of the immediately surrounding cylindrical members.

4. The device of claim 3 wherein said outwardly extending flange of said outer cylindrical member is adapted to contact said inwardly extending flange of said one end of said rod whereby said outer cylindrical member will be mounted for movement in unison with said rod when said outwardly extending flange of said outer cylindrical member contacts said inwardly extending flange of said one end of said rod and said detent on said outer member is in contact with said one end of said rod.

5. The device of claim 4 wherein said detents are resilient, each of said cylindrical members which has another cylindrical member telescoping therein has a longitudinal slot to accommodate the detent of the cylindrical member immediately telescoping therein, and said one end of said rod has a longitudinal slot defined thereon adapted to accommodate said detent of said outer cylindrical member.

6. The device of claim 4 also including a supply container having a reservoir of fluid material contained therein, and a fluid line connected to said supply container and said housing.

7. The device of claim 6 also including a second valve for selectively allowing addition of fluid material from said supply container to said chamber.

8. The device of claim 7 wherein said supply container has a sealed pressurized capsule therein, said sealed capsule containing said fluid material, and means for allowing passage of material from said capsule to said fluid line by connection of said capsule to said fluid line.

* * * * *